US011844478B2

(12) United States Patent
McDonnell

(10) Patent No.: US 11,844,478 B2
(45) **Date of Patent: *Dec. 19, 2023**

(54) SPRAY MOP

(71) Applicant: For Life Products, LLC, Miramar, FL (US)

(72) Inventor: Joseph A. McDonnell, Weston, FL (US)

(73) Assignee: For Life Products, LLC, Miramar, FL (US)

( * ) Notice: Subject to any disclaimer, the term of this patent is extended or adjusted under 35 U.S.C. 154(b) by 95 days.

This patent is subject to a terminal disclaimer.

(21) Appl. No.: 17/487,594

(22) Filed: Sep. 28, 2021

(65) Prior Publication Data

US 2022/0079410 A1 Mar. 17, 2022

Related U.S. Application Data

(63) Continuation of application No. 16/543,969, filed on Aug. 19, 2019, now Pat. No. 11,147,429, which is a continuation of application No. 15/600,465, filed on May 19, 2017, now Pat. No. 10,383,502.

(51) Int. Cl.

| | |
|---|---|
| ***A47L 13/00*** | (2006.01) |
| ***A47L 13/22*** | (2006.01) |
| ***A47L 13/24*** | (2006.01) |
| ***A47L 13/254*** | (2006.01) |
| ***A47L 13/255*** | (2006.01) |
| *A47L 13/10* | (2006.01) |
| *A47L 13/31* | (2006.01) |
| *A47L 13/28* | (2006.01) |

(52) U.S. Cl.

CPC ..... *A47L 13/22* (2013.01); *A47L 13/24* (2013.01); *A47L 13/254* (2013.01); *A47L 13/255* (2013.01); *A47L 13/10* (2013.01); *A47L 13/28* (2013.01); *A47L 13/31* (2013.01)

(58) Field of Classification Search

CPC ..... A47L 13/22; A47L 13/24; A47L 13/255; A47L 13/10; A47L 13/31; A47L 13/28; A47L 13/254

See application file for complete search history.

(56) References Cited

U.S. PATENT DOCUMENTS

| | | | | |
|---|---|---|---|---|
| 7,048,458 | B2 | 5/2006 | Hall | |
| 7,172,099 | B2 * | 2/2007 | Hofte | A47L 13/22 222/481.5 |
| 9,788,702 | B1 * | 10/2017 | Zhu | A47L 13/22 |
| 2012/0093563 | A1 * | 4/2012 | Ganeson | A47L 13/22 401/25 |

* cited by examiner

*Primary Examiner* — Jennifer C Chiang

(74) *Attorney, Agent, or Firm* — Merchant & Gould P.C.

(57) ABSTRACT

The spray mop includes a handle having a mop head at its lower end and a grip at its upper end. The mop includes a receiver adapted to hold an inverted bottle of cleaning solution, as sold at retail with an attached sprayer. The mop includes an adapter that is screwed onto the bottle of cleaning solution after the original sprayer is removed, whereby the bottle of cleaning solution can be inverted and inserted into the receiver. A spring-loaded retainer securely holds the bottle of cleaning solution in the receiver so that if the mop is dropped, inverted, or bumped there will be no leakage, while a trigger on a handgrip at the upper portion of the mop handle activates a valve in the adapter whereby cleaning solution is dispensed through a spray nozzle at the lower portion of the receiver.

8 Claims, 4 Drawing Sheets

SPRAY MOP

CROSS-REFERENCE TO RELATED APPLICATIONS

The present application is a continuation of U.S. application Ser. No. 16/543,969, filed Aug. 19, 2019, which is a continuation of U.S. application Ser. No. 15/600,465, filed May 19, 2017, now U.S. Pat. No. 10,383,502, issued Aug. 20, 2019, the disclosures of which are hereby incorporated by reference in their entirety.

BACKGROUND OF THE INVENTION

The present invention pertains generally to the household cleaning. In particular, the invention is a mop that includes a sprayer that is able to spray cleaning products that are sold for use with or without the mop described herein.

While mops, and spray mops, are known in the art, heretofore such spray mops have required the use of particular spray canisters specifically designed and sold to fit particular mops. As such, when one purchased a spray mop, the spray mop typically came with an initial canister, loaded with the appropriate cleaning solution, and when the solution in that canister was depleted, the canister had to be either refilled or replaced. Accordingly, retailers selling such mops had to stock several different items in addition to the initial mop (or mop kit), e.g., filled replacement canisters, as well as bottles of solution for refilling the canisters. In fact, at least one manufacturer supplies refills in various sized bottles and flexible bags having a refill spigot.

The presence of numerous items—mop kits, filled replacement canisters, refill bottles of solution in various sizes and configurations, as well as the existence of the very same cleaning solutions in various sized spray bottles—meant that retailers of such spray mops had to maintain a relatively large number of "stock keeping units" ("SKUs"), as each item, e.g., the initial mop kit, the canisters, the refills, and the various filled spray bottles, each had their own SKU. Maintaining a large number of diverse SKUs for what was, essentially, the same product (e.g., the cleaning fluid within the initial spray mop kit, the replacement canisters, the refills, and the standalone spray bottles, possibly of different sizes) meant that retailers had to deal with stocking, ordering, and shelf space issues.

SUMMARY OF THE INVENTION

The present invention pertains to a spray mop that is adapted to use the standard spray bottle of cleaning solution that is sold to those who do not have, or choose to use, a spray mop.

In particular, the present invention includes a mop with a handle that extends from a mop head at its distal end, typically having a cloth or other wipe attached thereto, up to its proximal head that typically includes a "trigger" lever that can be depressed by the user to cause a cleaning solution to be sprayed from a spray nozzle on the lower portion of the mop handle. Above the spray nozzle there is a receiver having a size and shape adapted to receive a standard retail container of the cleaning solution, wherein the standard retail container is typically sold with an attached sprayer.

In accordance with the present invention the sprayer affixed to the retail container can be unscrewed and removed by the user and replaced by a screw-on "mop adapter" that allows the retail container to be inverted and inserted into the receiver on the spray mop. The mop adapter includes a valve and an air vent, whereby when the retail container has been inserted into the receiver, cleaning solution is dispensed through the spray nozzle on the lower portion of the mop when the user depresses the trigger at the proximal end of the mop's handle, thereby directing a spray of the cleaning solution ahead of the mop.

In the preferred embodiment of the invention, the receiver further includes a spring-loaded retainer that is adapted to allow multiple sized retail containers to be inserted and retained therein.

DETAILED DESCRIPTION OF THE PREFERRED EMBODIMENTS

Figure 1:
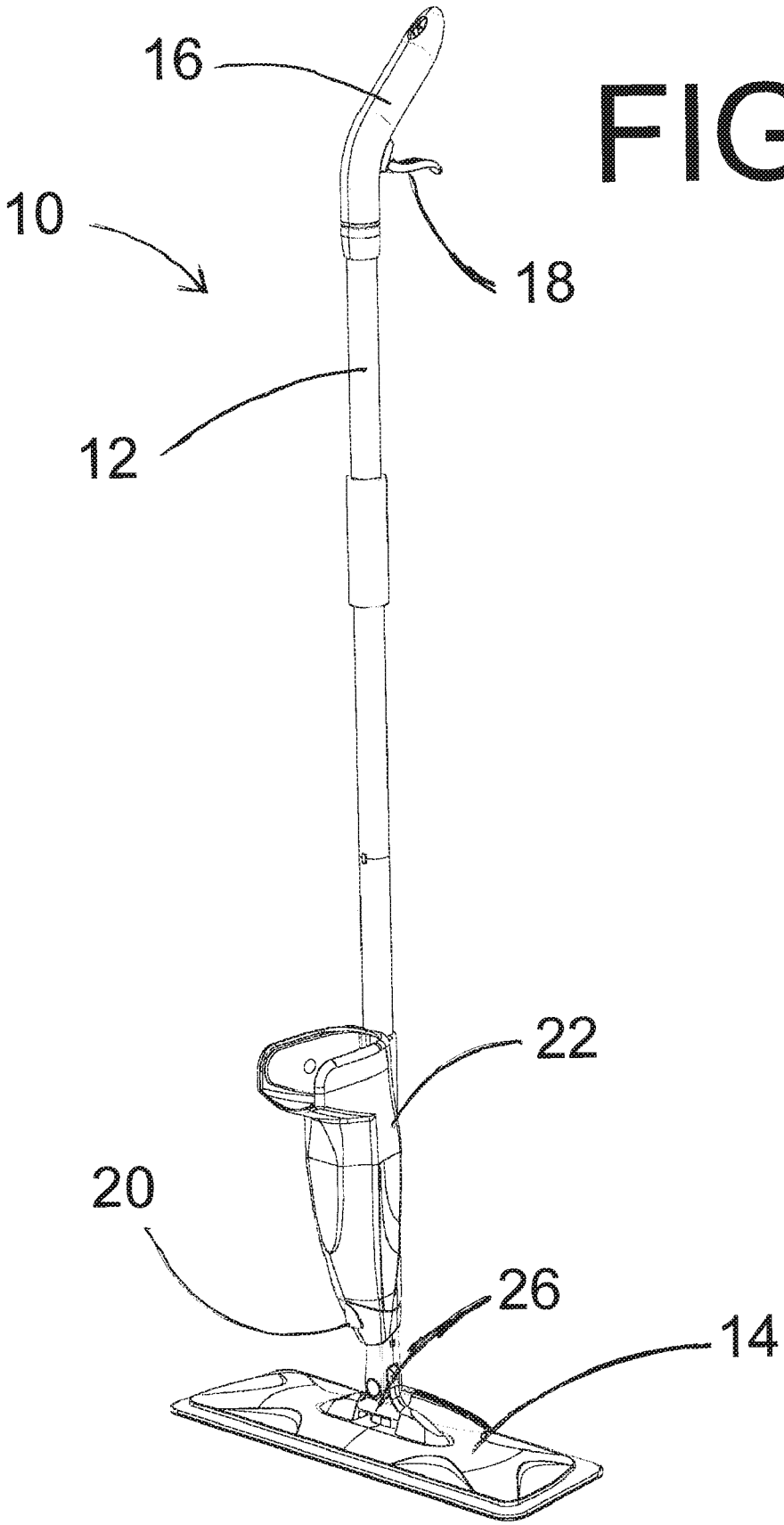
FIG. 1 illustrates a perspective view of the preferred embodiment of the invention.
Figure 2:
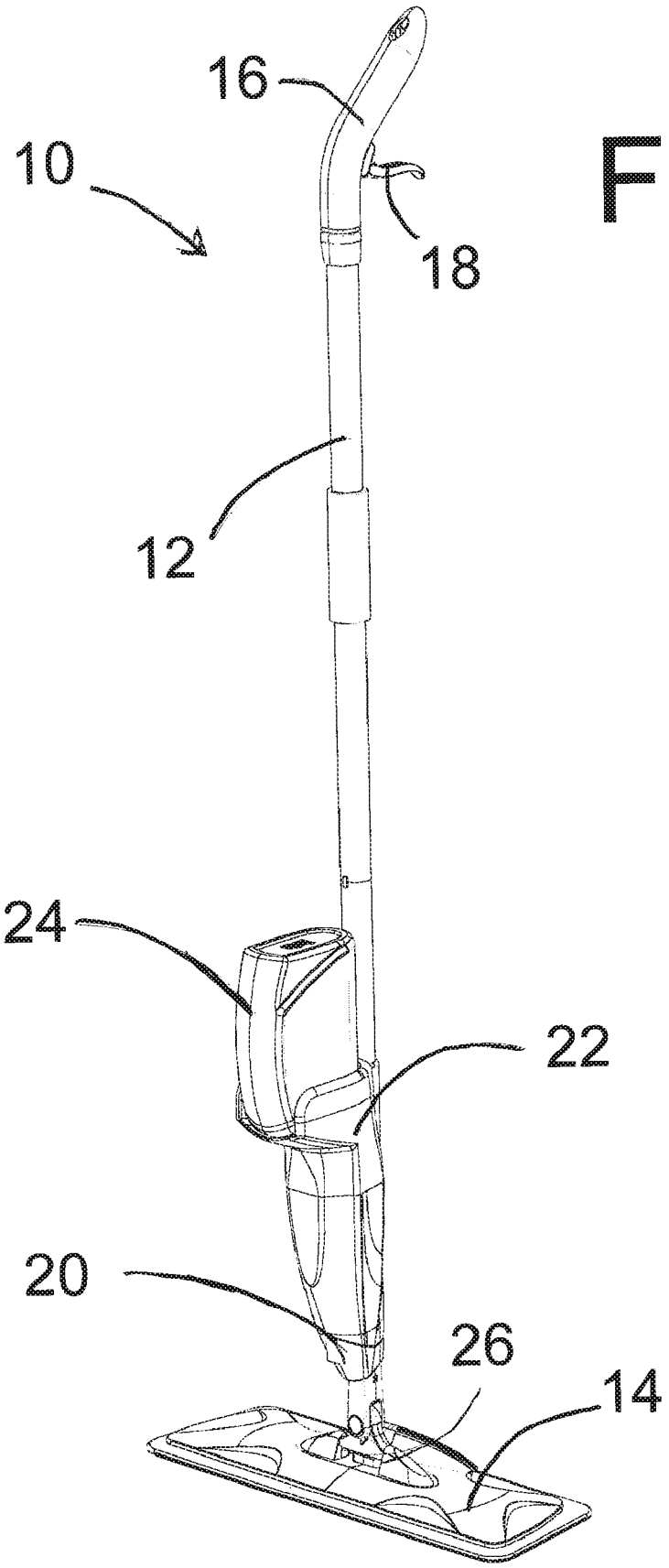
FIG. 2 illustrates the mop of the preferred embodiment of the invention with a container of cleaning solution in the receiver of the mop of FIG. 1.

Referring to FIGS. 1 and 2, the spray mop 10 of the present invention that is adapted to use standard retail spray bottle product, rather than canisters of cleaning solution, is shown. The spray mop 10 includes a handle 12 having a mop head 14 at its distal end and a handgrip 16, at its proximal end. As shown the handgrip 16 includes a lever, or trigger, that a user can depress to cause cleaning solution to be sprayed from a nozzle 20 that is mounted beneath a receiver 22.

As shown in FIG. 2, the receiver 22 has a shape and configuration adapted to receive an inverted retail container 24 of cleaning solution. As will be explained hereinafter, the receiver 22 further includes a spring-loaded retainer (See FIGS. 4 and 5) that permits the receiver 22 to hold various sizes of retail containers 24 of cleaning solution.

As is common, the mop 10 further includes a swivel 26 that allows the handle 12 to be raised and lowered relative to the mop head 14. Also, those skilled in the art will recognize that the mop head 14 is designed to hold a cleaning pad, such as a microfiber pad, with the microfiber pad being held in place by any suitable means, such as clamping or by using hook-and-loop (e.g., Velcro) fasteners on the underside of the head 14.

As will be understood by those skilled in the art, various elements of the inventive mop 10, such as the mop head 14, and the internal mechanisms that allow and cause the cleaning solution to be dispensed are known in the art. However, the unique and inventive aspect of the present mop 10 is that the receiver 22 has a shape and configuration specifically adapted to hold and retain standard retail containers of cleaning solution, as shown in FIG. 2.

Figure 3:
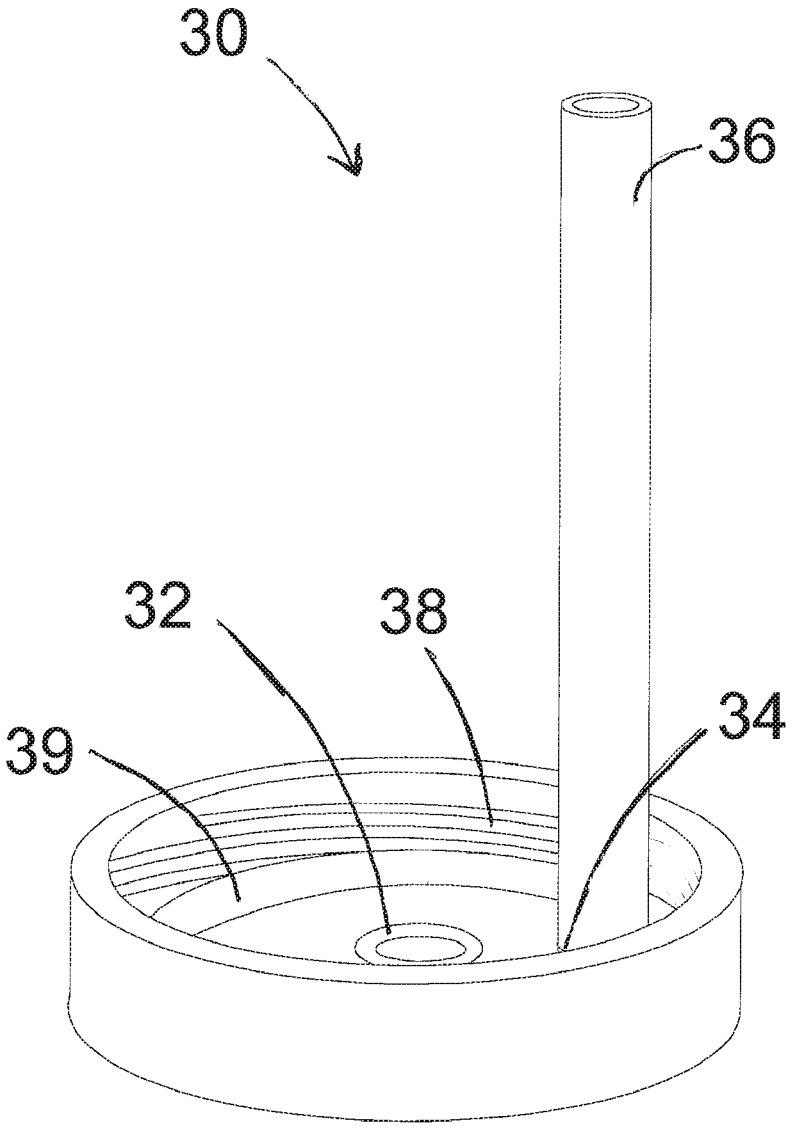
FIG. 3 illustrates the adapter used with the invention to replace the sprayer on a retail container of spray solution whereby the container can be inverted and inserted into the receiver on the mop.

Referring to FIG. 3, in order to use the mop 10 of the present invention with a standard retail container of cleaning solution of the type typically sold with a sprayer top, the sprayer top is unscrewed from the retail container (i.e., the "spray bottle"), and it is replaced by a simple adapter 30 having a centrally positioned valve 32 along with an offset air vent 34 attached to a vent tube 36. The adapter 30 includes internal threads 38 sized to fit the container of cleaning product, whereby the adapter 30 can be screwed onto the bottle 24 when the top (which is often a sprayer) is removed. The adapter 30 also includes a seal, such as a resilient washer or a rubber O-ring 39 to prevent leakage when the mop 10 is assembled with a bottle 24 in the receiver 22.

As will be understood by those skilled in the art, when a retail bottle (or container) of spray solution is sold, with an attached sprayer, a "supply" tube extends down into the container so that when the sprayer is activated (by hand pumping or otherwise) cleaning solution is drawn from the bottom of the spray bottle. A vent hole in the sprayer top allows air to enter the spray bottle as cleaning solution is sprayed, whereby there will be no interruption of the spraying due to reduced pressure within the spray bottle.

When a standard spray bottle 24 is used with the present mop 10, the retail container 24 must be inverted, as shown in FIG. 2. Thus, when used with the mop 10, the former top of the container 24 is inserted into the receiver 22, so the cleaning solution does not travel up a tube to the sprayer. However, air must still be introduced into the container 24 when it is used with the mop 10, whereby the vent tube 36 provides a way for air to enter the container 24 above the level of the cleaning solution therein so as to prevent decreased pressure from interrupting the flow of cleaning solution from the container 24 when it is used in the mop 10 while also preventing cleaning solution from dripping from the container 24. As will be understood by those skilled in the art, when the lever 18 is squeezed a rod within the handle 12 pushes down and opens the valve 32 and pumping cleaning solution from the container 24 to be sprayed from the nozzle 20.

Figure 4:
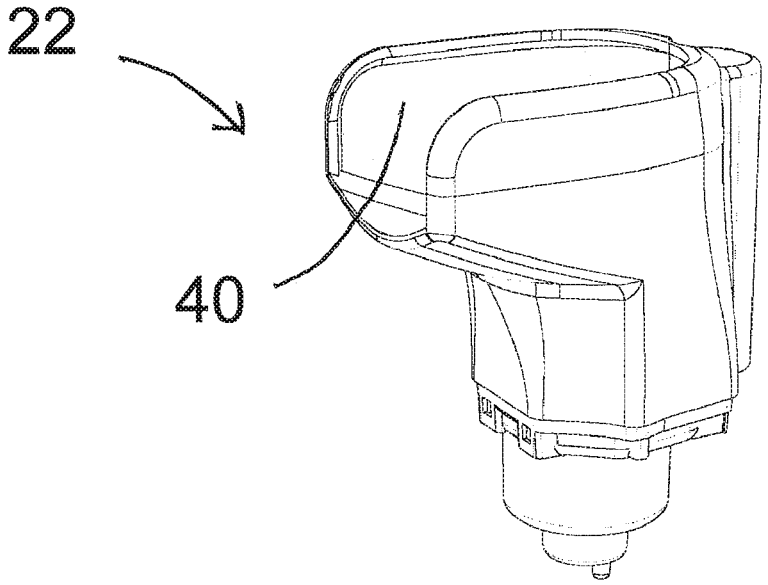
FIG. 4 illustrates the receiver that allows a plurality of different sized spray containers to be used with the mop.
Figure 5:
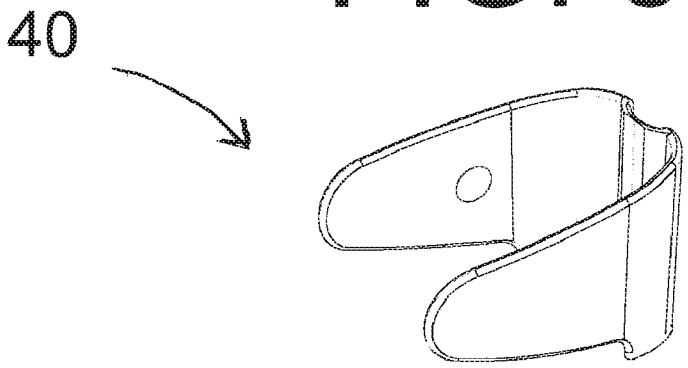
FIG. 5 illustrates the spring-loaded retainer within the receiver that allows a plurality of different sized spray containers to be used with the mop.

Another feature of the preferred embodiment of the invention is illustrated in FIG. 4, which shows that the receiver 22 holds a spring-loaded retainer 40 (See FIG. 5) designed to securely hold various sized retail containers of cleaning solutions. By way of example, a particular retailer may sell retail spray bottles containing either 32 ounces or 40 ounces of cleaning solution. The spring-loaded retainer 40 allows either the 32-ounce size, or the 40-ounce size, of the spray bottle 24 to be held in the retainer 22. In addition, the spring-loaded retainer 40 is configured to securely retains the bottle 24 so that it does not fall out or leak in the event that the mop 10 is dropped or inverted (e.g., to be hung up for storage) by a user.

A great advantage of the present invention is that particular cleaning product suppliers often package their cleaning products in identically shaped bottles. For example, For Life Products, LLC sells a number of floor cleaning products (e.g., hardwood floor cleaner, marble cleaner, vinyl floor cleaner, shine refresher, tile cleaner, and stone cleaner) under their Rejuvenate trademark. In order for a retailer to carry each of those six cleaners in canisters for the spray mops heretofore known, an additional six SKUs would be required for that single supplier, and if canister refills (bottles and/or bags) are added, then even more SKUs would be required, and that is for only a single supplier. With the present invention, only a single new SKU is required for a mop 10 having a receiver 22 with an internal shape ("female") that conforms to the manufacturer's bottle's shape ("male"). Further, by using the spring-loaded retainer 40 it is possible for the mop 10 of the present invention to be used with different sized containers.

In addition, the use of the mop 10 of the present invention with the simple screw-on adapter 30 (FIG. 3) means that no reservoir has to be refilled, as on some of the spray mops previously known, as such refilling is not only messy, but may also require retail outlets to add additional SKUs for the refills.

Finally, as should be obvious to one skilled in the art, while each version of the mop 10 of the present invention is specifically configured to have a receiver 22 that is specifically designed to act with a particular product container configuration, whereby each mop 10 would be specific to a particular manufacturer's containers, the design of a new mop 10, for a different manufacturer's containers can be readily accomplished by using the new container to mold a new receiver 22 configured to fit that container.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

I claim:

1. A spray mop adapted to use standard retail containers of cleaning solution, the spray mop comprising:

an elongated handle having a proximal end and a distal end;

a receiver affixed to the lower portion of said handle, said receiver having a shape and configuration adapted to hold an inverted retail container of cleaning solution;

a spray nozzle at the lower portion of said receiver, said spray nozzle being adapted to disburse cleaning solution; and a spring-loaded retainer located within the receiver, the spring-loaded retainer being configured to retain the container of solution, wherein the spring loaded retainer is able to securely retain the container in the receiver.

2. The spray mop of claim 1 wherein said adapter has a thread pattern designed to mate with a standard retail container of cleaning solution, whereby said adapter can be screwed onto said retail container upon removal of any spray or other cap thereon.

3. The spray mop of claim 1 wherein said adapter includes a seal to prevent leakage when said adapter is screwed onto said standard retail container of cleaning solution.

4. The spray mop of claim 3 wherein said seal is comprised of an O-ring.

5. The spray mop of claim 3 wherein said seal is comprised of a resilient washer.

6. The spray mop of claim 1 further comprising a spring-loaded retainer located within said receiver, said spring-loaded retainer being configured to retain said standard retail container of cleaning solution.

7. The spray mop of claim 6 wherein said spring-loaded retainer is able to securely retain containers of different sizes in said receiver.

8. The spray mop of claim 6 wherein said spring-loaded retainer has sufficient strength to retain said container in said receiver even if said mop is inverted or bumped while in use.

* * * * *